US009475061B2

(12) United States Patent
Aries et al.

(10) Patent No.: US 9,475,061 B2
(45) Date of Patent: Oct. 25, 2016

(54) PAPER SHREDDER WITH STAPLE AND CLIP REMOVER

(71) Applicant: ACCO UK Limited, Aylesbury (GB)

(72) Inventors: Paul A. Aries, Brierley Hill (GB); Kaushik Patel, Northwood (GB)

(73) Assignee: ACCO UK Limited, Aylesbury (GB)

( * ) Notice: Subject to any disclaimer, the term of this patent is extended or adjusted under 35 U.S.C. 154(b) by 0 days.

(21) Appl. No.: 15/137,283

(22) Filed: Apr. 25, 2016

(65) Prior Publication Data

US 2016/0236201 A1 Aug. 18, 2016

Related U.S. Application Data

(63) Continuation of application No. 14/162,957, filed on Jan. 24, 2014, which is a continuation of application No. 13/927,899, filed on Jun. 26, 2013, now Pat. No. 8,672,251, which is a continuation of application No.

(Continued)

(51) Int. Cl.
*B02C 23/08* (2006.01)
*B02C 18/00* (2006.01)
(Continued)

(52) U.S. Cl.
CPC ..... *B02C 18/2283* (2013.01); *B02C 18/0007* (2013.01); *B02C 18/2225* (2013.01); *B02C 23/02* (2013.01); *B02C 23/04* (2013.01); *B02C 23/08* (2013.01); *B02C 2018/003* (2013.01); *B02C 2018/0046* (2013.01)

(58) Field of Classification Search
CPC ..... B02C 18/0007; B02C 18/2283; B02C 2018/0046; B02C 2018/003; B02C 23/02; B02C 18/2225
USPC ..... 241/81, 100, 225, 236
See application file for complete search history.

(56) References Cited

U.S. PATENT DOCUMENTS 4,821,967 A * 4/1989 Moriyama ..... B02C 18/0007 241/223
5,354,001 A * 10/1994 Hasegawa ..... H04N 1/4473 241/100

(Continued)

FOREIGN PATENT DOCUMENTS

DE 2731247 11/1978
DE 202005003921 6/2005

(Continued)

OTHER PUBLICATIONS

UK Search Report for GB Application No. 1313671.8 dated Nov. 19, 2013 (4 pages).

(Continued)

*Primary Examiner* — Faye Francis
*Assistant Examiner* — Onekki Jolly
(74) *Attorney, Agent, or Firm* — Michael Best & Friedrich LLP

(57) ABSTRACT

A paper shredder includes a housing, cutters positioned in the housing, and a feeder base coupled to the housing and adapted to support a stack of papers. The feeder base includes a feeder slot through which paper passes for shredding in the cutters. The feeder base further includes an aperture formed in the feeder base at a location spaced from the feeder slot. The aperture provides a pathway between a top surface of the feeder base and a waste area below the feeder base and has an edge with multiple surfaces that enhance an ability of the edge to peel away sheets of paper from the stack.

25 Claims, 11 Drawing Sheets

Related U.S. Application Data

13/723,400, filed on Dec. 21, 2012, now Pat. No. 8,496,197, which is a continuation of application No. 12/762,000, filed on Apr. 16, 2010, now Pat. No. 8,336,794.

(51) Int. Cl.

| | |
|---|---|
| ***B02C 18/22*** | (2006.01) |
| ***B02C 23/02*** | (2006.01) |
| ***B02C 23/04*** | (2006.01) |

(56) References Cited

U.S. PATENT DOCUMENTS

| | | | | |
|---|---|---|---|---|
| 6,550,701 | B1 | 4/2003 | Chang | |
| 7,387,268 | B2 | 6/2008 | Dahle et al. | |
| 7,500,627 | B2 | 3/2009 | Park et al. | |
| 7,658,342 | B2 * | 2/2010 | Chang | B02C 18/0007 241/225 |
| 8,196,851 | B2 | 6/2012 | Aries et al. | |
| 8,336,794 | B2 | 12/2012 | Aries et al. | |
| 8,496,197 | B2 | 7/2013 | Aries et al. | |
| 8,727,255 | B2 | 5/2014 | Kim | |
| 2005/0274836 | A1 | 12/2005 | Chang | |
| 2006/0175444 | A1 | 8/2006 | Chen | |
| 2006/0249609 | A1 | 11/2006 | Huang | |
| 2007/0181722 | A1 | 8/2007 | Dahle et al. | |
| 2008/0245908 | A1 | 10/2008 | Romanovich et al. | |
| 2010/0032505 | A1 | 2/2010 | Jensen et al. | |
| 2010/0032507 | A1 | 2/2010 | Chen | |
| 2010/0044484 | A1 | 2/2010 | Chen | |
| 2010/0059612 | A1 | 3/2010 | Huang | |
| 2010/0096482 | A1 | 4/2010 | Chang | |

FOREIGN PATENT DOCUMENTS

| | | |
|---|---|---|
| EP | 281136 | 9/1988 |
| GB | 2450255 | 12/2008 |
| JP | 05-007789 | 1/1993 |
| JP | 938513 | 2/1997 |
| JP | 2007-254150 | 10/2007 |
| JP | 2007268500 | 10/2007 |
| JP | 2009-119398 | 6/2009 |
| JP | 20111136321 | 7/2011 |
| WO | 9312022 | 6/1993 |
| WO | 01/54820 | 8/2001 |
| WO | 2010098599 | 9/2010 |

OTHER PUBLICATIONS

UK IPO Combined Search and Examination report dated Sep. 2, 2013 (5 pages).
PCT/IB2011/000647 Invitation to Pay Additional Fees, with Partial International Search Report, date of mailing Aug. 3, 2011, 5 pages.
Search Report for International Application no. PCT/IB2011/000647 dated Nov. 9, 2011, 6 pages.
Written Opinion for International Application No. PCT/IB2011/000647 dated Nov. 9, 2011, 8 pages.
Combined Search Report and Examination Report for GB Application No. 1223052.0 dated Feb. 26, 2013, 5 pages.
Machine Translation of WO0154820, 13 pages.
International Search Report for International Application No. PCT/IB2011/000651 dated Dec. 20, 2011, 7 pages.
Written Opinion for International Application No. PCT/IB2011/000651 dated Dec. 20, 2011, 8 pages.
Invitation to Pay Additional Fees and, Where Applicable, Protest Fee for International Application No. PCT/IB2011/000651 dated Nov. 8, 2011, 7 pages.
Examiner's Report from the United Kingdom Intellectual Property Office for Application No. 1218192.1 dated Oct. 24, 2012, 3 pages.
Japanese Office Action for Japanese Application No. 2013-504354 corresponding to PCT/IB2011/000651, 9 pages.
Machine Translation of JP938513, 29 pages.
UK IPO Examination Report for GB1223052.0 under Section 18(3) Dated Sep. 2, 2013, 2 pages.
UK Examination Report for GB Appl. No. 1312096.9 dated May 7, 2014, 4 pages.
UK Examination Report for GB Appl. No. 1312096.9 dated Aug. 20, 2014, 4 pages.
European Search Report for EP Appl. 14155646.4, dated Apr. 2, 2014, 6 pages.

* cited by examiner

PAPER SHREDDER WITH STAPLE AND CLIP REMOVER

RELATED APPLICATIONS

This application is a continuation of U.S. patent application Ser. No. 14/162,957 filed on Jan. 24, 2014, which is a continuation of U.S. patent application Ser. No. 13/927,899 filed on Jun. 26, 2013, now U.S. Pat. No. 8,672,251, which is a continuation of U.S. patent application Ser. No. 13/723,400 filed on Dec. 21, 2012, now U.S. Pat. No. 8,496,197, which is a continuation of U.S. patent application Ser. No. 12/762,000 filed on Apr. 16, 2010, now U.S. Pat. No. 8,336,794, the entire contents of which are hereby incorporated by reference herein.

BACKGROUND

The present invention generally relates to the field of paper shredders, and specifically to paper shredders that have a mechanism for removing staples and paper clips prior to shredding.

Paper shredders are commonly used to shred documents in order to preserve the confidentiality of the information on the documents. Shredders come in a variety of sizes, from large industrial shredders capable of shredding stacks of sheets of paper at one time, to personal and office shredders that can shred up to several sheets at one time.

Personal and office shredders are commonly designed to have paper hand fed into the shredder. These shredders include a slot, typically on the top of the shredder, and sheets of paper are fed into the slot. While these shredders are often designed to accommodate staples and paper clips, it is desirable to remove staples and paper clips prior to shredding in order to prevent damage to or jamming of the shredder.

Some shredders are designed to accommodate a stack of paper for shredding. These shredders commonly pull sheets of paper from the bottom of a stack for shredding several sheets at a time. When shredding a stack of paper, staples or paper clips can be embedded in the stack, and thus it is impractical to remove all staples and paper clip prior to shredding. While these shredders can often accommodate staples and paper clips, it would be desirable to have a system for removing staples and paper clips from sheets of paper within a stack prior to shredding.

SUMMARY OF THE INVENTION

The present invention provides a paper shredder. The shredder includes a housing, cutters positioned in the housing, and a feeder base coupled to the housing and adapted to support a stack of papers. The feeder base includes a feeder slot through which paper passes for shredding in the cutters. The feeder base further includes an aperture formed in the feeder base at a location spaced from the feeder slot. The aperture provides a pathway between a top surface of the feeder base and a waste area below the feeder base and has an edge closest to the feeder slot including a compound angle with a first section oriented at a first angle relative to the feeder slot, and a second section oriented at a second angle relative to the feeder slot. The first angle is different from the second angle. The edge extends an entire width of the aperture as measured in a direction parallel to the feeder slot.

The present invention also provides a paper shredder including a housing, cutters positioned in the housing, and a feeder base adapted to support a stack of paper. The feeder base includes a feeder slot. The feeder base further includes a first aperture on one side of the feeder slot and a second aperture on a same side of the feeder slot as the first aperture. The first and second apertures provide pathways between a top surface of the feeder base and a waste area below the feeder base. The first and second apertures are spaced apart from one another by a portion of the feeder base between the first and second apertures. Each of the first and second apertures has an edge including a compound angle with a first section oriented at a first angle relative to the feeder slot, and a second section oriented at a second angle relative to the feeder slot. The first angle is different from the second angle.

The present invention also provides a paper shredder including a housing, cutters positioned in the housing, and a feeder base adapted to support a stack of paper. The feeder base includes a feeder slot. The feeder base further includes an aperture formed in the feeder base at a location spaced from the feeder slot. The aperture provides a pathway between a top surface of the feeder base and a waste area below the feeder base and has an edge closest to the feeder slot with an angle that varies relative to the feeder slot.

The present invention also provides a paper shredder including a housing, cutters positioned in the housing, and a feeder base adapted to support a stack of paper. The feeder base includes a feeder slot. The feeder base further includes an aperture formed in the feeder base at a location spaced from the feeder slot. The aperture provides a pathway between a top surface of the feeder base and a waste area below the feeder base and has an edge with multiple surfaces that enhance an ability of the edge to peel away sheets of paper from the stack.

Other aspects of the invention will become apparent by consideration of the detailed description and accompanying drawings.

DETAILED DESCRIPTION

Figure 1:
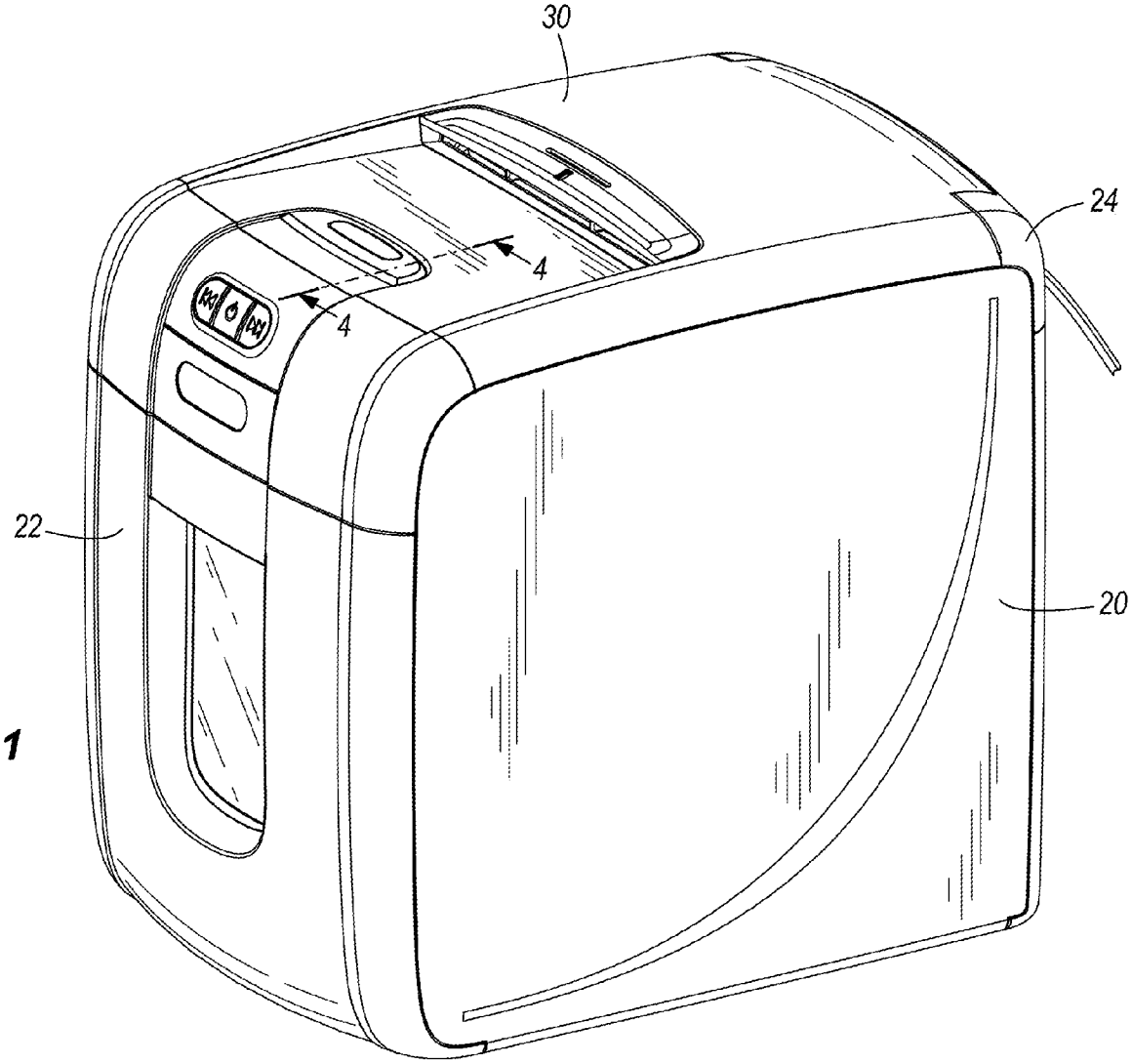
FIG. 1 illustrates a paper shredder embodying the present invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

The illustrated shredder includes a housing 20, a litter bin 22 positioned in the housing 20, a top cover 24 mounted on top of the housing 20, an engine assembly 26 mounted in the top cover 24, a feeder base 28 mounted on the top cover 24, and a feeder assembly 30 pivotally mounted to the feeder base 28. By pivoting the feeder assembly 30 upward, a stack of paper 32 can be placed on the feeder base 28 in preparation for shredding. The feeder assembly 30 is then closed, and the shredding operation is performed by pulling bottom sheets of the stack of paper 32 through the feeder base 28 and into the engine assembly 26. The paper passes through rotary cutters 34 (FIG. 8) in the engine assembly 26, which shred the paper and drop it into a waste area where the litter bin 22 is positioned. After shredding is completed, the litter bin 22 can be slid out the front of the housing 20 for disposal.

Figure 2:
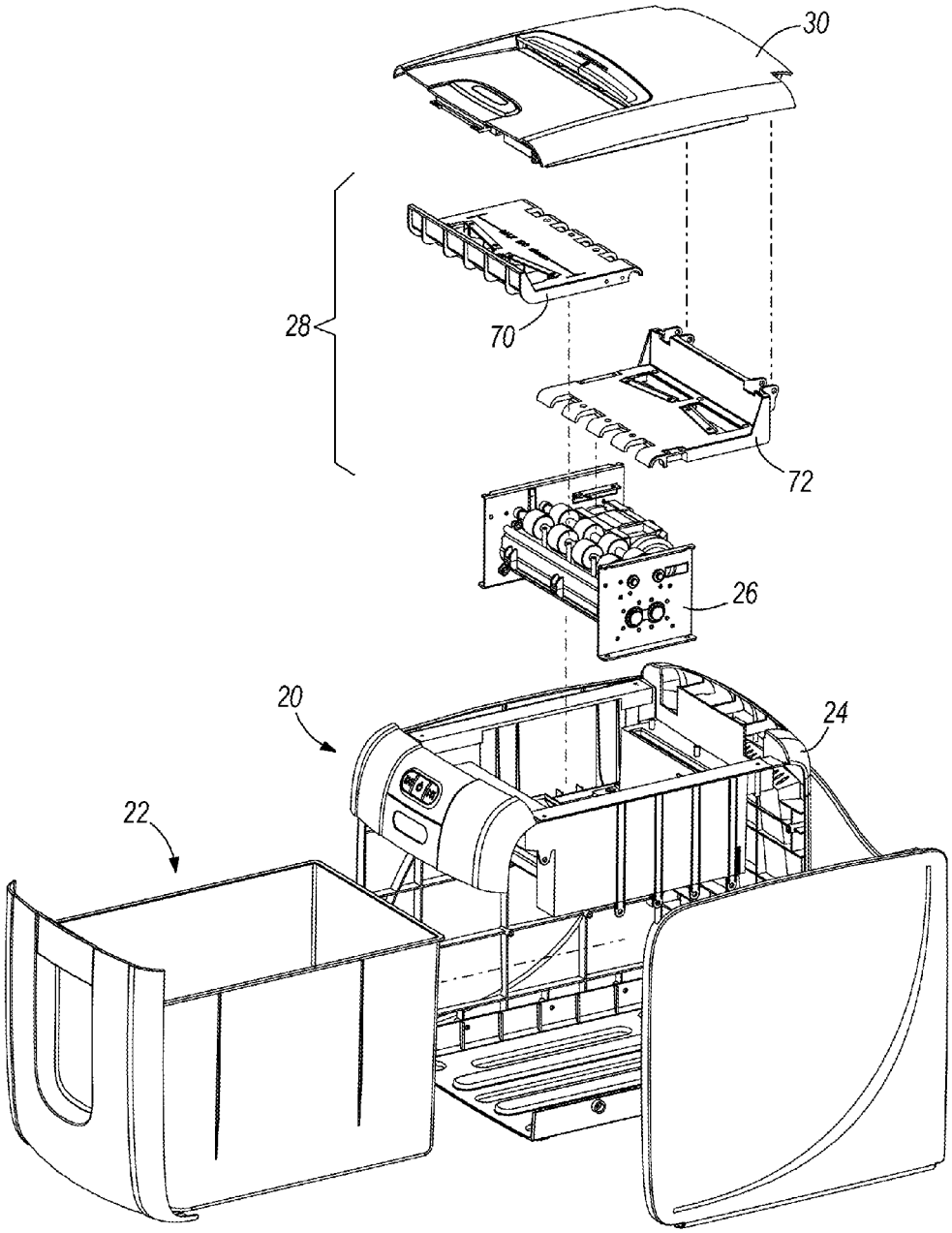
FIG. 2 is an exploded view of the shredder of FIG. 1.
Figure 3:
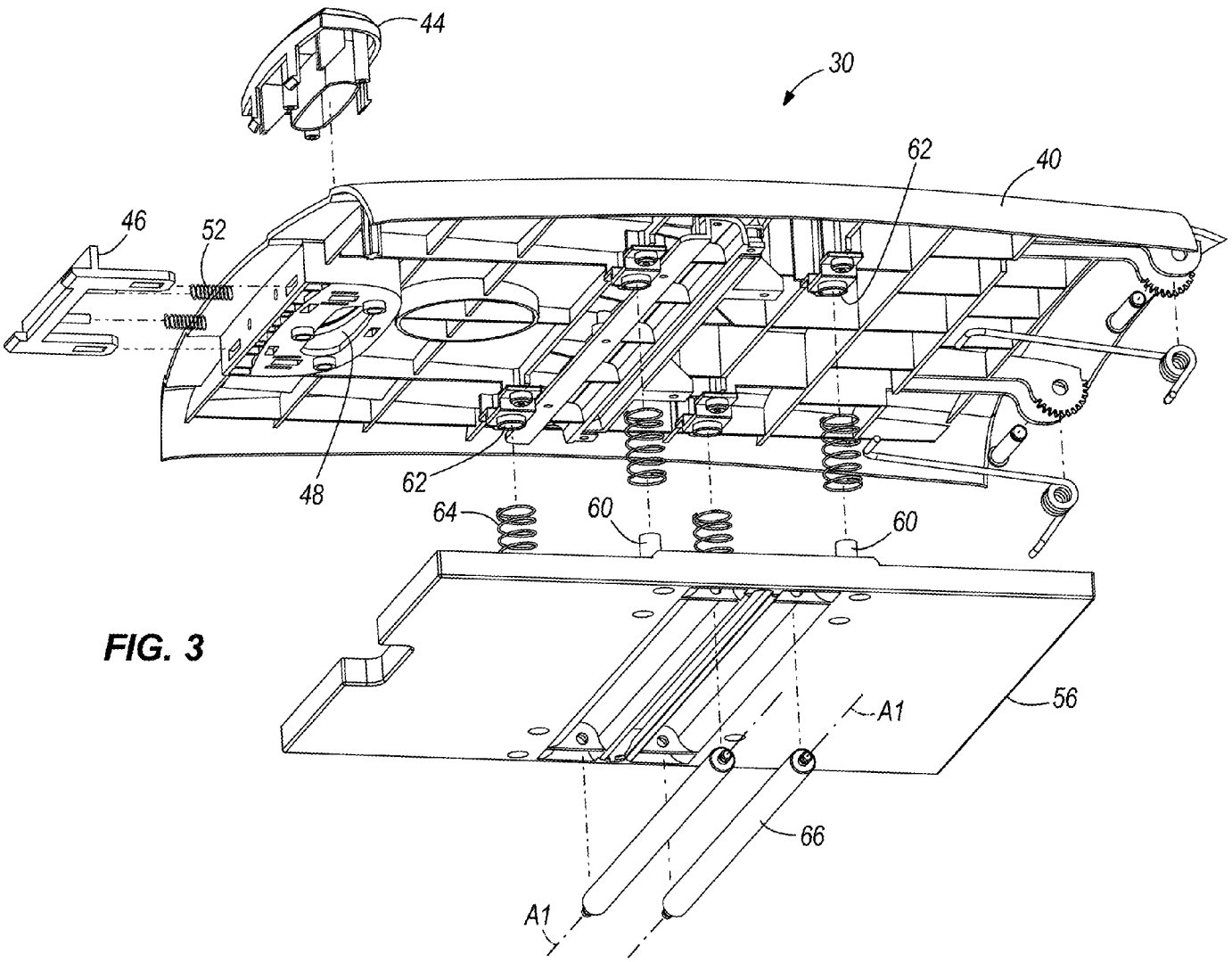
FIG. 3 is an exploded view of a feeder assembly of the shredder of FIG. 1.
Figure 4:
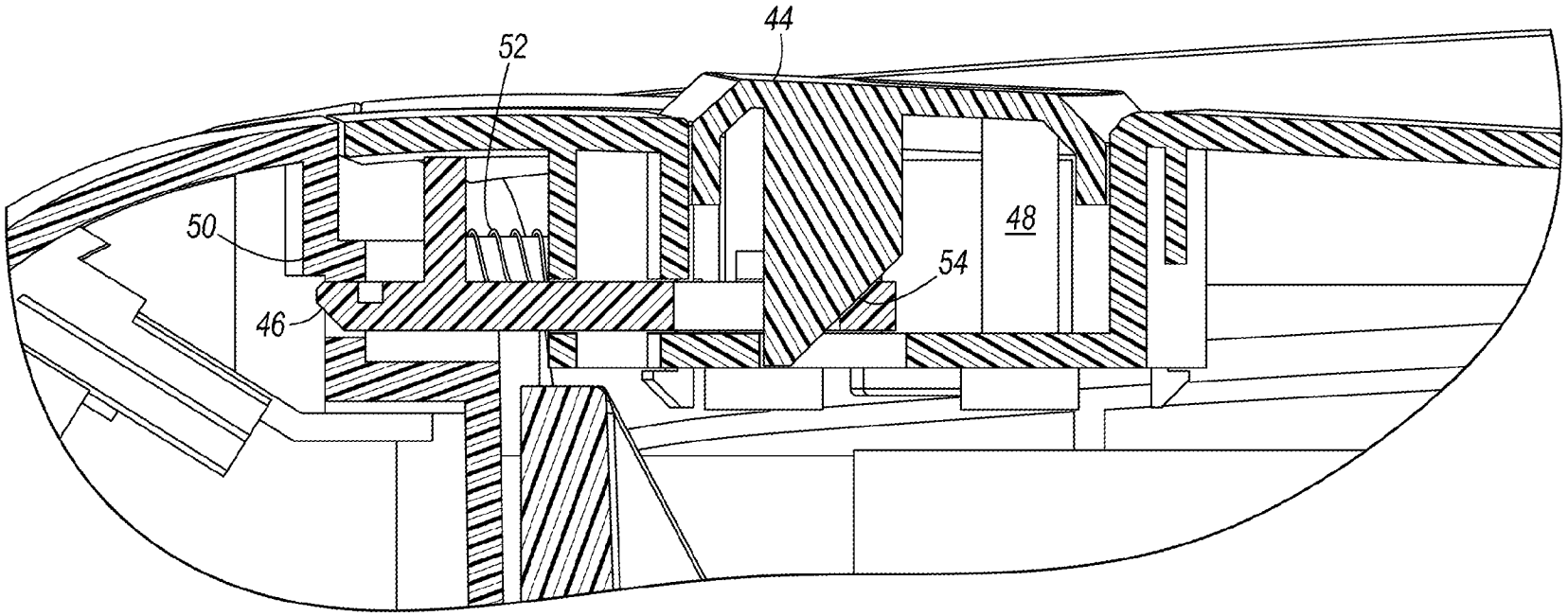
FIG. 4 is a section view taken along line 4-4 of FIG. 1.

The feeder assembly 30 is shown in more detail in FIGS. 2-4. The feeder assembly 30 includes a feeder door 40 pivotally mounted to the feeder base 28 and moveable between a lowered position and a raised position. The illustrated feeder door 40 is a one-piece door that substantially covers the entire feeder base and is pivoted about an axis at one end of the feeder door 40. Two turn springs 42 bias the feeder door 40 toward the raised position. A catch button 44 and latch 46 are mounted on the free end of the feeder door 40. The catch button 44 is positioned within an opening 48 in the feeder door 40 and is designed to be moveable vertically from a released position to a pressed position. The latch 46 is mounted for horizontal movement relative to the feeder door 40 between a latched position, where it engages a lip 50 (FIG. 4), and an unlatched position. A pair of latch springs 52 bias the latch 46 toward the latched position and, due to a camming interface 54 (FIG. 4) between the latch 46 and the catch button 44, such bias of the latch 46 also biases the catch button 44 toward the released position. When the catch button 44 is not pressed, it is in the released position and the latch 46 is in the latched position, which will hold the feeder door 40 in its lowered position relative to the top cover 24. When the catch button 44 is moved toward the pressed position, the latch 46 will be moved toward the unlatched position, which will release engagement between the latch 46 and the lip 50, and will allow the feeder door 40 to pivot upward to the raised position.

The feeder assembly 30 further includes a pressure plate 56 mounted adjacent the bottom surface of the feeder door 40. The pressure plate 56 is a one-piece member that includes a series of posts 60 that are dimensioned to slide within corresponding openings 62 in the feeder door 40 such that the pressure plate 56 can float vertically relative to the feeder door 40. A series of push springs 64 bias the pressure plate 56 away from the feeder door 40. Pressure rollers 66 are mounted to the pressure plate 56 and are aligned on opposing sides of a central portion of the pressure plate 56. The pressure rollers 66 can each rotate about axes A1 relative to the pressure plate 56, but their rotational axes A1 are fixed relative to each other. The pressure rollers 66 are designed to apply pressure to a top sheet of a stack of sheets positioned on the feeder base. It should be understood that, in some embodiments, the pressure plate could be made of multiple members. For example, the pressure plate could include a front plate and a rear plate that are completely separate or that are hinged together to allow some degree of independent movement. This would facilitate upward movement of one of the plates (e.g., to accommodate the passage of a staple) while maintaining downward pressure of the other plate (to keep pressure on the stack of paper).

The illustrated feeder base 28 comprises a front portion 70 and a rear portion 72, each of which includes an inner end 74 an outer end 76. Each of the inner ends 74 includes a series of notches 78 that are dimensioned to receive a series of rubber rollers 80 that are part of the engine assembly 26 and are substantially aligned with the pressure rollers 66. The rubber rollers 80 protrude slightly above a top surface of the feeder base 28 and are rotated by the engine assembly 26 to frictionally draw sheets of paper through a feeder slot 84 and into the rotary cutters 34. This action is facilitated by the one-piece pressure plate that spans the feeder slot, and by downward pressure provided by the pressure rollers 66 positioned on opposing sides of the feeder slot 84. As such, when the paper is being drawn into the cutters 34, the paper moves toward the feeder slot 84. The rear portion 72 of the feeder base 28 includes hinges 86 that pivotally support the feeder door 40 for pivoting about an axis A2. It should be understood that, in some embodiments, the feeder base 28 could be made of a single member (see FIG. 11) instead of separate front and rear portions.

Each of the front portion 70 and the rear portion 72 of the feeder base 28 includes two apertures 90 that provide an opening between the top surface of the feeder base 28 (which supports a stack of paper 32 in preparation for shredding) and the waste area where the litter bin 22 is positioned below the feeder base 28. Each aperture 90 is positioned at a corner of the feeder base 28. That is, each aperture 90 is approximately aligned with a corner of a sheet of paper positioned on the stack.

Figure 5:
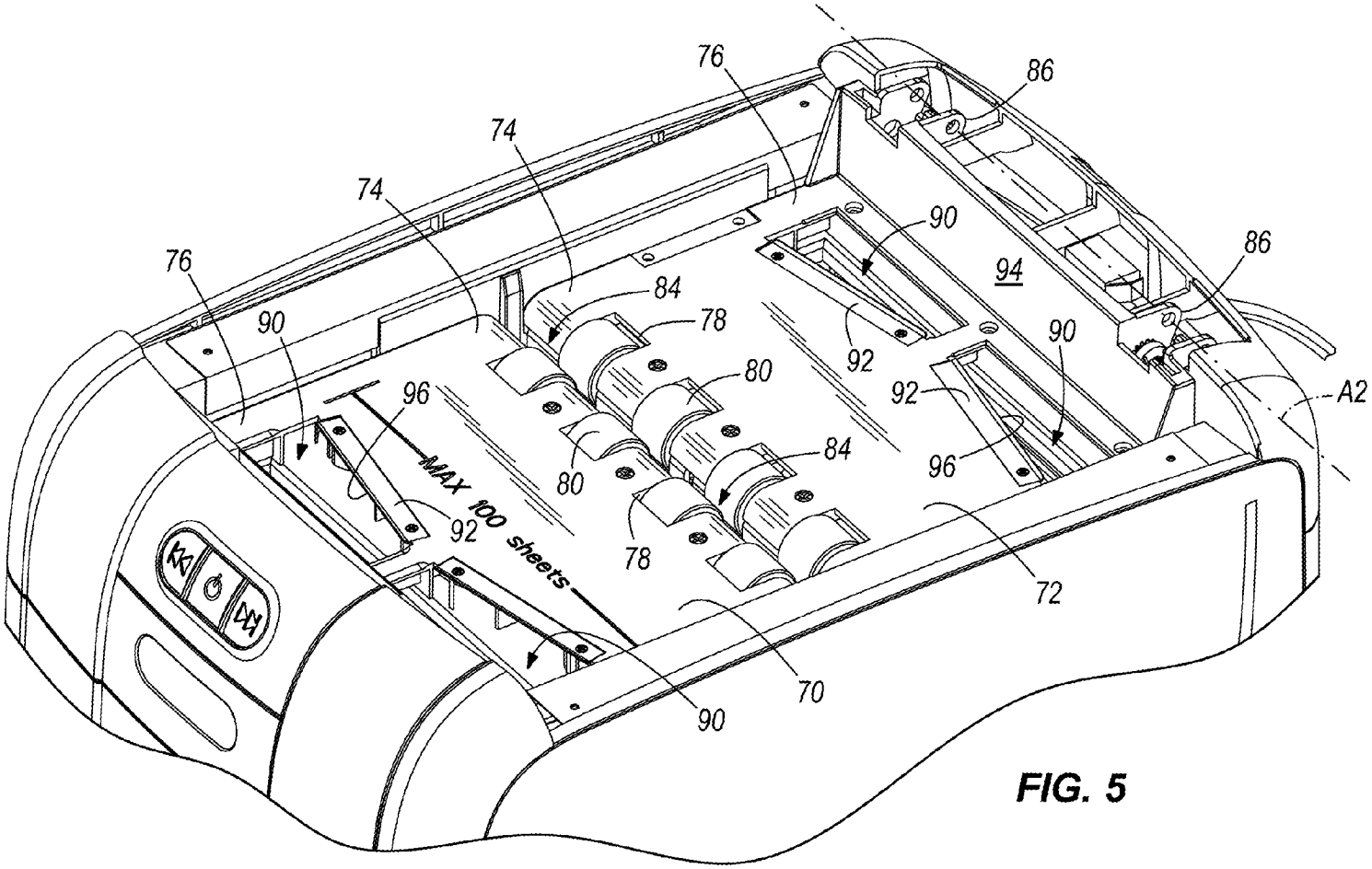
FIG. 5 is a perspective view of the shredder of FIG. 1 with the feeder assembly removed.
Figure 6:
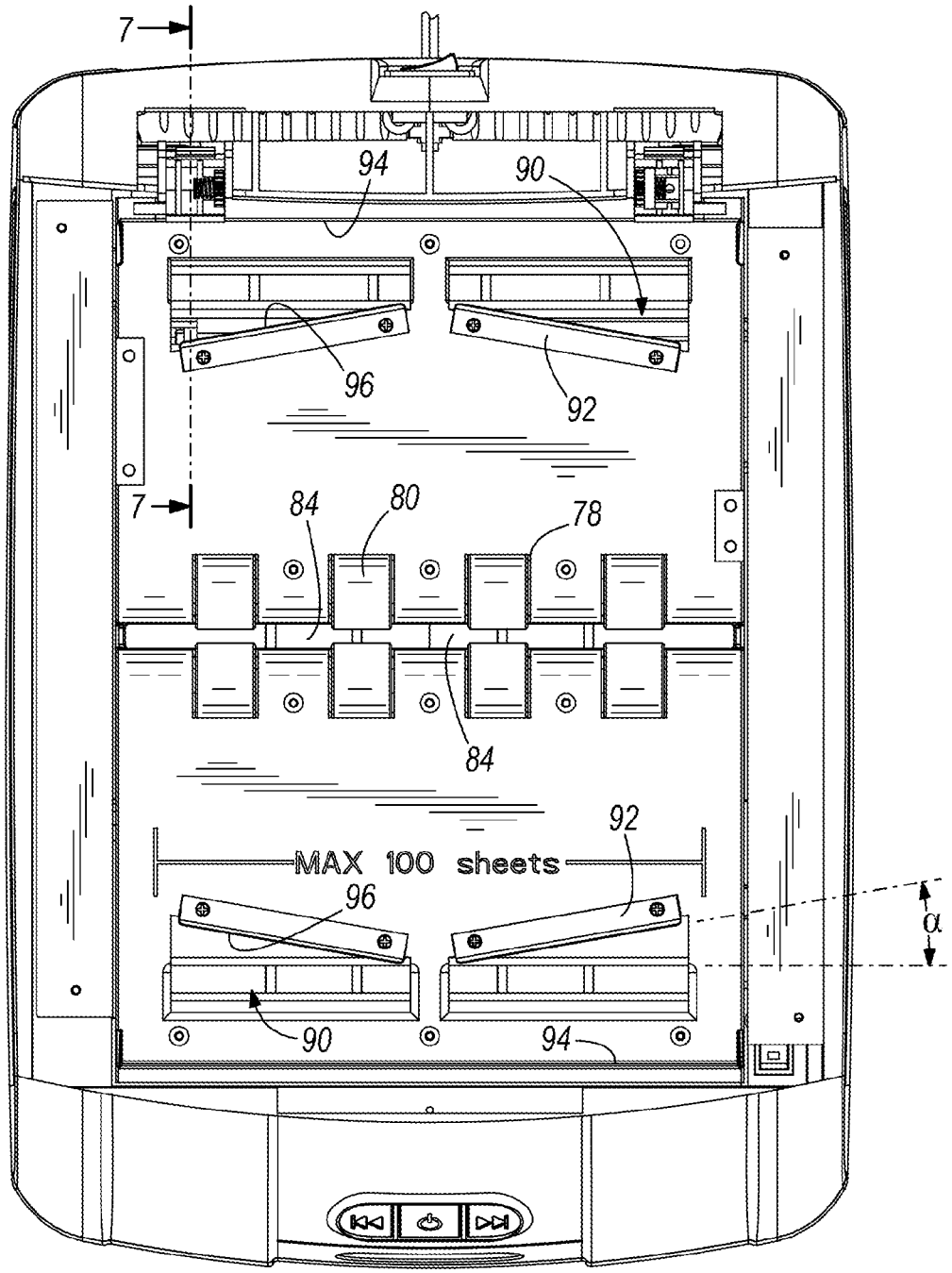
FIG. 6 is a top view of the shredder shown in FIG. 5.

A staple plate 92 is secured to the feeder base 28 adjacent each of the apertures 90. As best shown in FIGS. 5-6, each staple plate 92 is positioned at an oblique angle relative to the feeder slot 84 and relative to a side edge 94 of the feeder base 28. In the illustrated embodiment, the staple plates 92 include an edge 96 positioned above a plane defined by the top surface of the feeder base 28. The illustrated edge 96 faces the aperture 90 and is at an angle $\alpha$ (FIG. 6) of about 10 degrees relative to the feeder slot 84 and relative to the side edge 94 of the feeder base 28. As used herein, a "staple plate" is used as a convenient term to describe a plate that can be used to separate a staple S (FIG. 6), paper clip, or other paper-fastening device from a sheet or sheets of paper. The staple plate 92 need not have a straight edge, but instead could have an edge with an angle that varies relative to the feed slot 84. In this regard, the angle of the edge of the staple plate 92 at any point shall be considered the tangent to the edge at that point. It should also be noted that, while the illustrated embodiment of FIGS. 1-9 utilizes the edge 96 of the staple plate 92 to define a portion of the aperture 90, the staple plate 92 could be eliminated, in which case the "edge" would be defined by a portion of the feeder base 28 (see, e.g., the second embodiment of FIG. 10).

Figure 7:
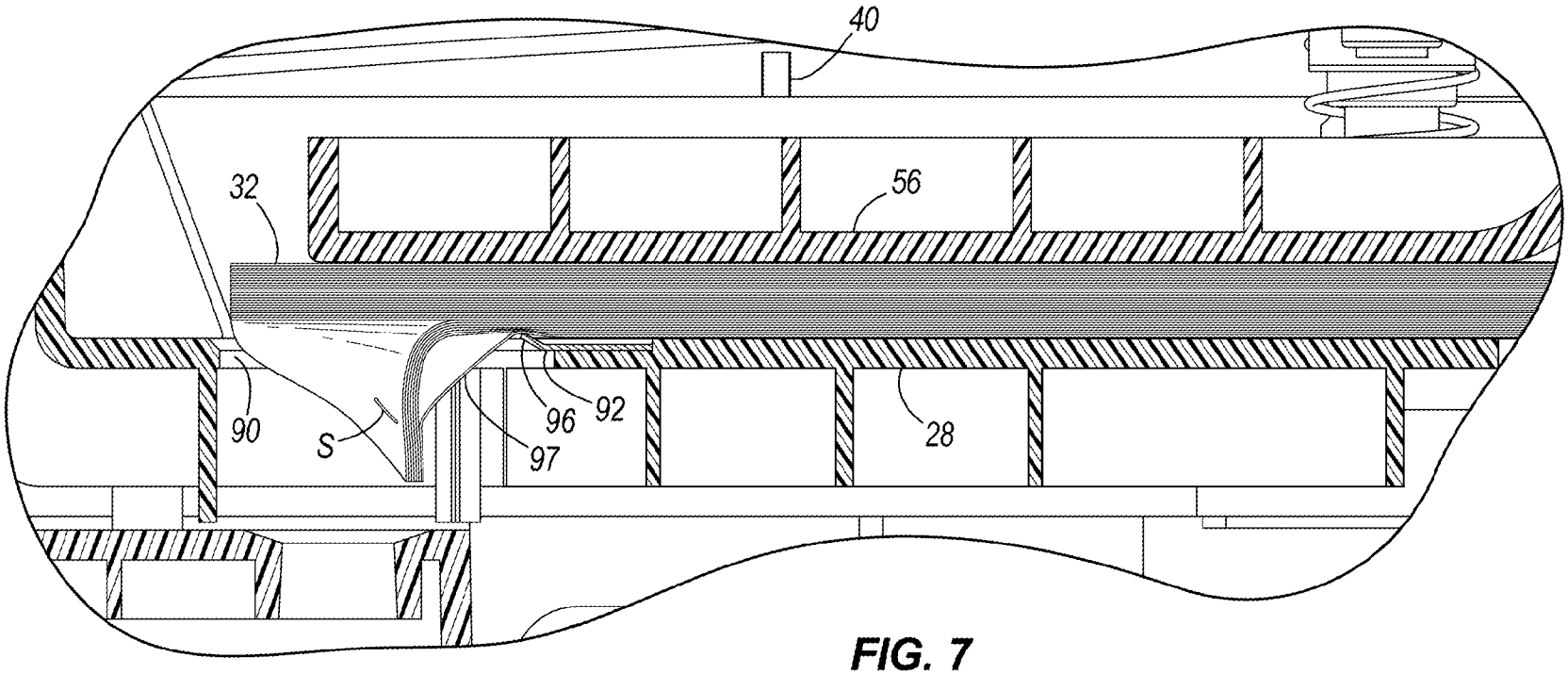
FIG. 7 is a section view taken along line 7-7 in FIG. 6.

By positioning the edge 96 of the staple plate 92 at an oblique angle $\alpha$ relative to the feeder slot 84, the bottom sheets 97 of paper will move in a direction that is oblique to the edge 96 of the staple plate 92. This orientation causes the corner of a stapled stack of paper to fold over in a dog-eared fashion, as shown in FIG. 7. When in this position, further movement of the bottom sheets 97 of paper toward the feeder slot (to the right in FIG. 7) causes the bottom sheets 97 to peel away from the staple S. If not for the dog-eared corner, the bottom sheets 97 would need to shear through the staple S, which is more difficult to do consistently and often causes the entire stapled stack of paper to be sucked into the feeder slot and into the cutters, which can cause a jam. After the bottom sheets 97 tear away from the staple S, the next several sheets are pulled into the feeder slot 84, and the operation continues as described above. When the last several sheets of a staple stack are pulled into the feeder slot 84, the staple S will be slid toward the feeder slot 84 and into engagement with the edge 96 of the staple plate 92, where it should be held in place while the remaining sheets are torn away from the staple S. The staple S (and any small pieces of paper attached to the staple S) will then fall through the aperture 90 and into the litter bin 22.

Figure 8:
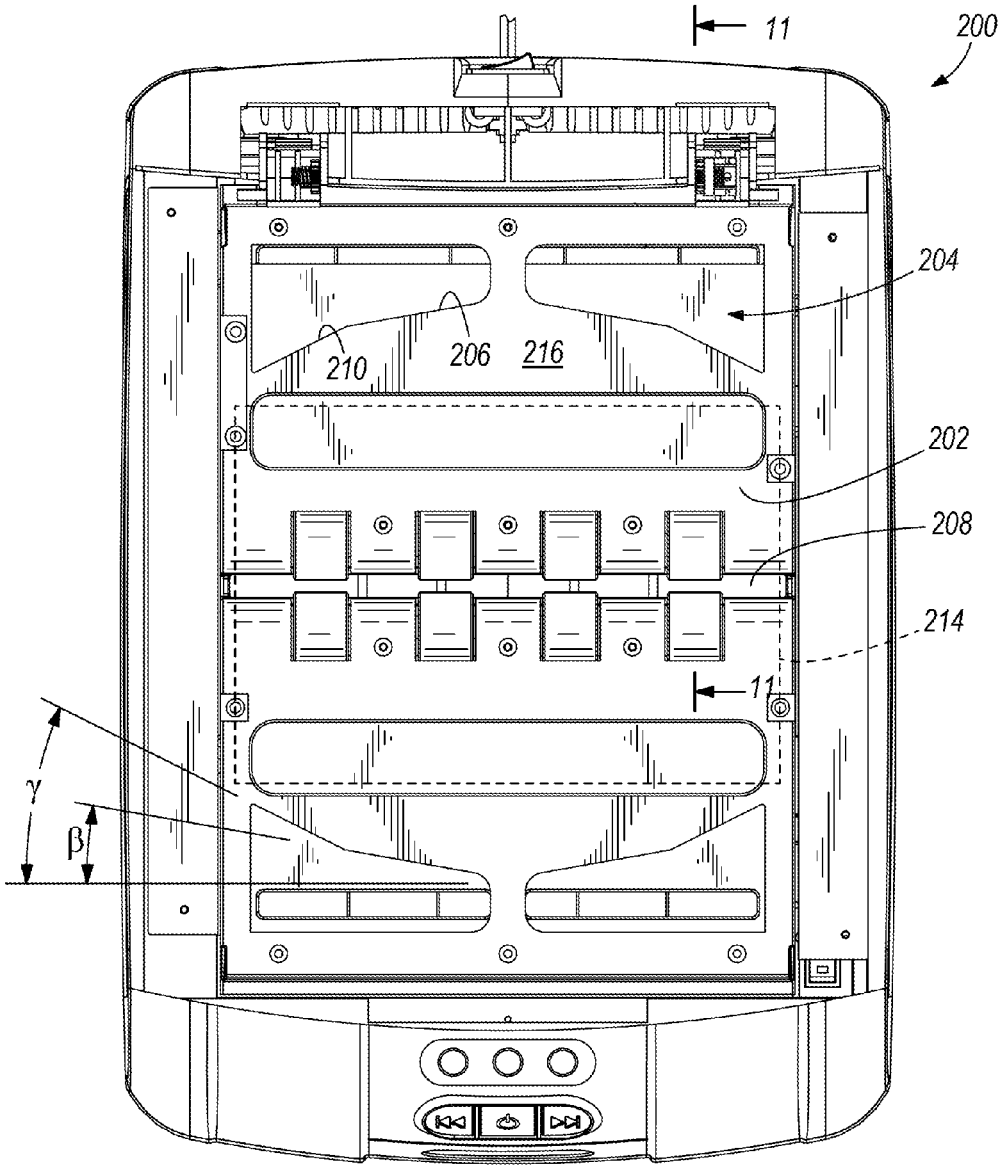
FIG. 8 is a top view of a shredder that is an alternate embodiment of the present invention.
Figure 9:
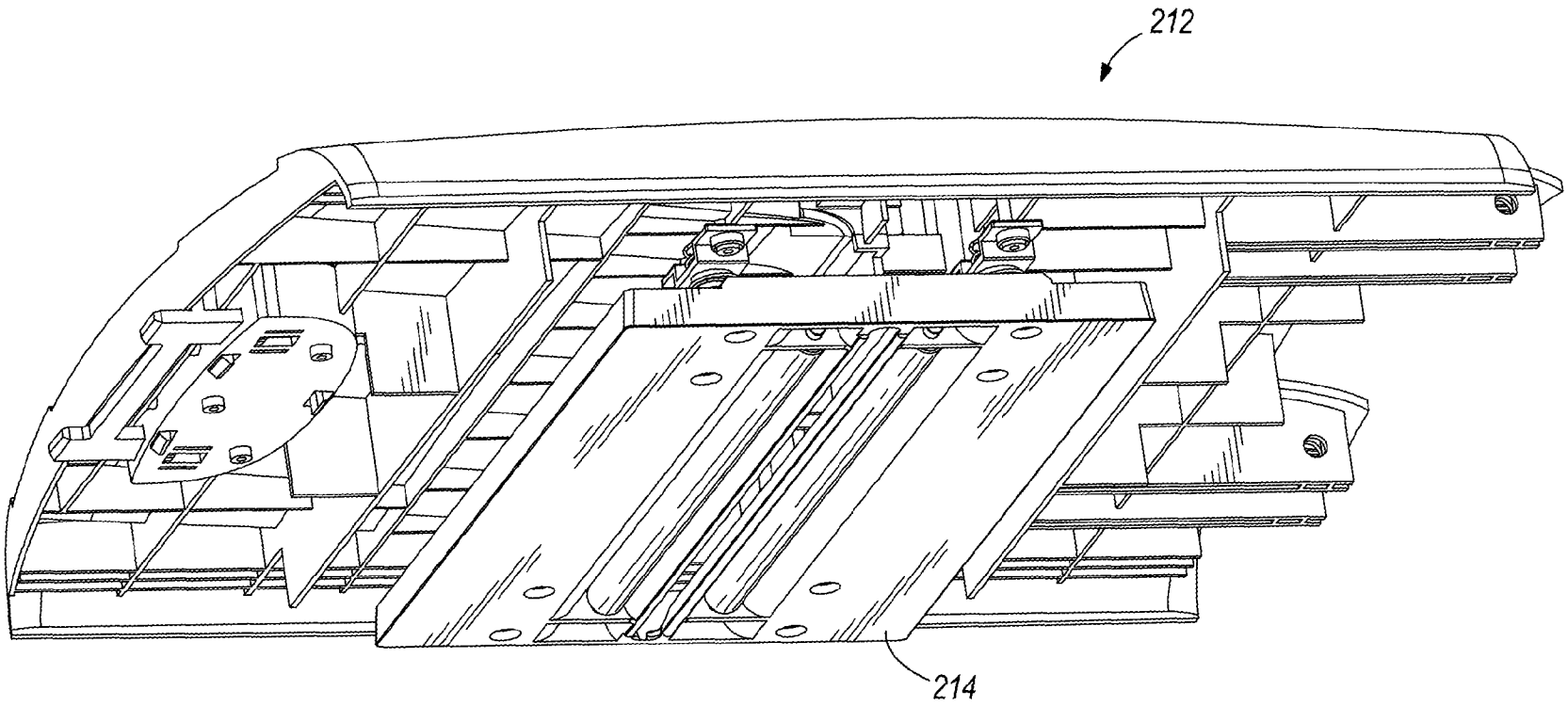
FIG. 9 is a bottom perspective view of a feeder assembly of the shredder of FIG. 10.
Figure 10:
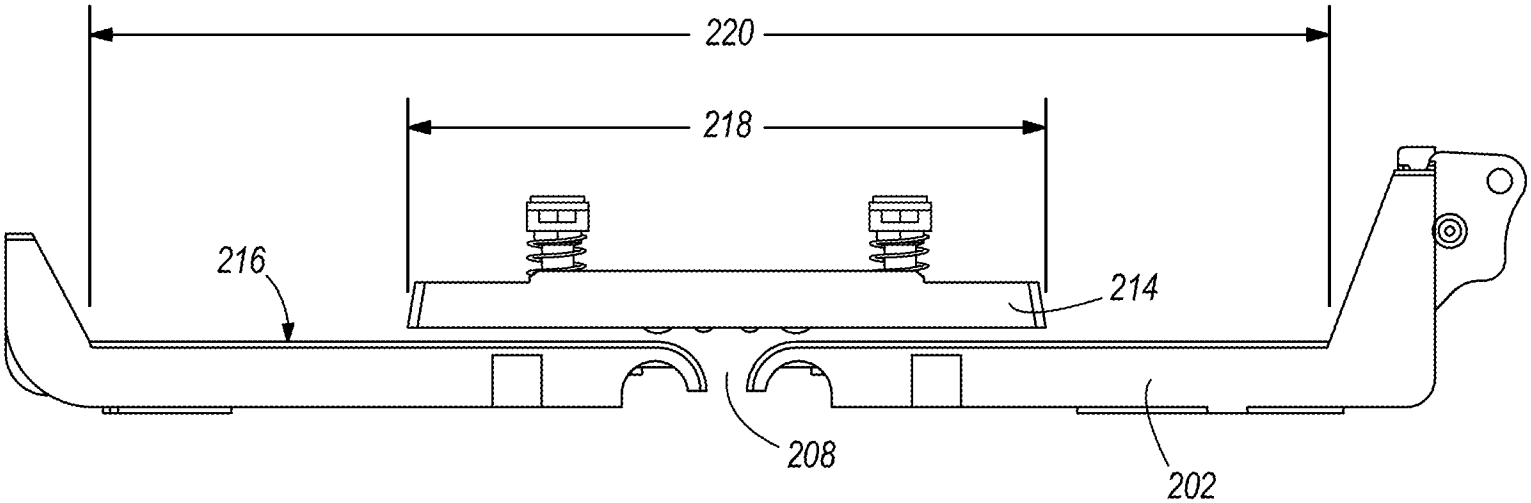
FIG. 10 is a side view of a pressure plate and feeder base of the second embodiment.

FIGS. 8-10 illustrate an alternate embodiment of the present invention. The illustrated shredder 200 has a feeder base 202 that is similar to the feeder base 28 of FIGS. 1-7, with the exception of the size and shape of the openings. More specifically, the openings 204 of the second embodiment do not include a staple plate 92. In addition, the edge of the opening 204 includes a compound angle having an inner first section 206 at an oblique angle β of about ten degrees relative to the feeder slot 208, and an outer second section 210 at an angle γ of about twenty-eight degrees relative to the feeder slot 208. This configuration has been found to enhance the ability of sheets of paper to peel-away from a stapled stack. That is, the steeper angle in the outer section 210 has been found to enhance the ability of a stack of sheets to fold over at the corner, thereby facilitating peeling of the lowest sheets of the stack away from the staple, as described above and illustrated in FIG. 7. In this embodiment, it has been found that the edge of the opening is sufficient to remove paper clips. In addition, because the cutters are designed to handle staples, it is acceptable if the last few sheets (the top sheets) in a stack of stapled sheets pull the staple into the cutters.

Referring to FIGS. 9-10, the feeder assembly 212 of the second embodiment includes a pressure plate 214 that is substantially shorter than the support surface 216 of the feeder base 202 that supports the stack of paper prior to shredding. More specifically, referring to FIG. 10, the pressure plate 214 has a length 218 perpendicular to the feeder slot 208 of about 144 mm, compared to a corresponding length 220 of the support surface 216 of about 284 mm. As a result, the pressure plate 214 has a length that is about 50% of the length of the support surface 216. In addition, the pressure plate 214 does not overlap with the openings 204 and the inner and outer sections 206,210 of the edge of the openings 204 that engage and slide paper clips off of stacks of sheets (best shown in broken lines in FIG. 8). This shorter pressure plate 214 functions to apply most of the pressure in the area of the feeder slot 208, so that the pressure of the paper on the rubber rollers 80 is enhanced. In addition, this design reduces lifting of the pressure plate when a stack of stapled sheets is folded at the corner (see FIG. 7). Such lifting of the pressure plate will result in a loss of friction on the rubber rollers 80, which can cause the shredder to slip (i.e., fail to draw sheets into the cutter due to insufficient friction between the rubber rollers 80 and the bottom sheet). As noted above in connection with the first embodiment, the pressure plate 214 can be made of multiple members. For example, the pressure plate 214 could be made from two members that are evenly positioned on opposing sides of the feeder slot and are coupled together by a hinged link. In such an embodiment with multiple pressure plate members, the above-referenced length and size of the pressure plate would be determined by looking at the combined or effective footprint of the pressure plate members.

Figure 11:
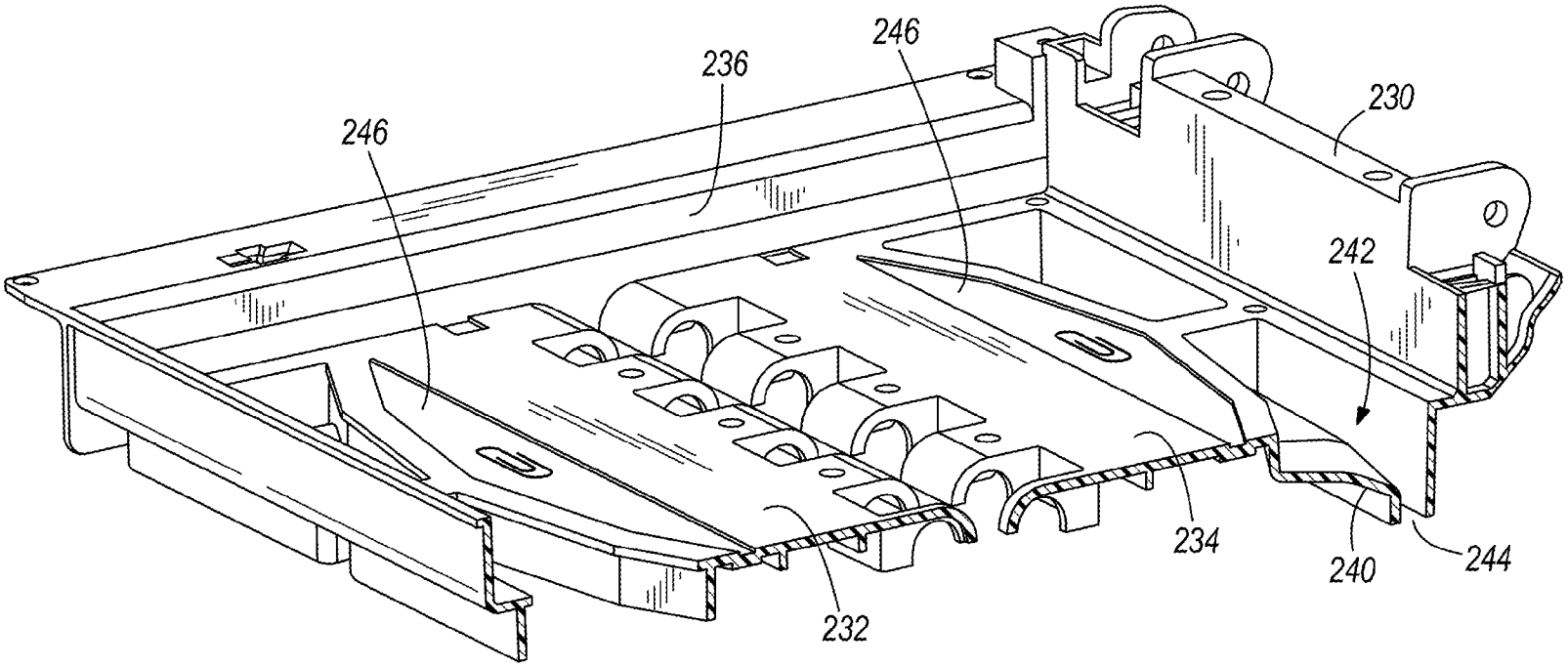
FIG. 11 is a perspective section view of a rear feeder base taken along line 11-11 in FIG. 8.

FIG. 11 illustrates an alternative embodiment for a feeder base 230 that is a one-piece design. More specifically, the front and rear portions 232, 234 of the feeder base 230 are connected by an integrally-formed side wall 236 along each side. In addition, the feeder base 230 includes a deflection member in the form of a plate 240 positioned in each opening 242 and tilted relative to horizontal. Each illustrated plate 240 will deflect paper clips that fall off the stacks of sheet being shredded, and will direct those paper clips into smaller ports 244 for falling into the litter bin (not shown in FIG. 11). These plates 240 guide the paper clips around other components of the shredder (e.g., the motor and circuit board). In addition, each of the front and rear portions 232,234 of the feeder base 230 includes a recessed portion 246 that will retain some paper clips that slide off and do not fall into the opening 242. This facilitates the saving and reusing of paper clips.

Various features of the invention are set forth in the following claims.

What is claimed is:

1. A paper shredder comprising:

a housing;

cutters positioned in the housing; and a feeder base coupled to the housing and adapted to support a stack of papers, the feeder base including a feeder slot through which paper passes for shredding in the cutters, the feeder base further including an aperture formed in the feeder base at a location spaced from the feeder slot, the aperture providing a pathway between a top surface of the feeder base and a waste area below the feeder base and having an edge closest to the feeder slot including a compound angle with a first section oriented at a first angle relative to the feeder slot, and a second section oriented at a second angle relative to the feeder slot, the first angle being different from the second angle;

wherein the edge extends an entire width of the aperture as measured in a direction parallel to the feeder slot.

2. The paper shredder of claim 1, wherein the edge defines a point having a tangent that is oblique to the feeder slot.

3. The paper shredder of claim 1, further comprising a deflection member for deflecting clips falling into the aperture.

4. The paper shredder of claim 3, wherein the deflection member is tilted relative to a horizontal plane to direct clips into a port providing passage into the waste area.

5. The paper shredder of claim 1, further comprising a feeder door that substantially covers the entire feeder base and is pivoted about an axis at one end of the feeder door; and a pressure plate mounted adjacent a bottom surface of the feeder door for applying pressure to the stack of papers.

6. The paper shredder of claim 5, wherein the pressure plate is biased away from the bottom surface of the feeder door by at least one biasing member.

7. The paper shredder of claim 5, wherein the pressure plate is a one-piece member.

8. The paper shredder of claim 1, wherein the feeder base is integrally-formed as one piece.

9. The paper shredder of claim 1, wherein the aperture is a first aperture and the feeder base further including a second aperture formed in the feeder base at a location spaced from the feeder slot and providing a pathway between a top surface of the feeder base and a waste area below the feeder base, the second aperture having an edge closest to the feeder slot including a compound angle with a first section oriented at a first angle relative to the feeder slot, and a second section oriented at a second angle relative to the feeder slot, the first angle being different from the second angle.

10. The paper shredder of claim 9, further comprising a pressure plate mounted adjacent a bottom surface of a feeder door for applying pressure to the stack of papers.

11. The paper shredder of claim 9, wherein the first aperture is positioned at a first corner of the feeder base and the second aperture is positioned at a second corner of the feeder base adjacent the first corner.

12. The paper shredder of claim 9, wherein a portion of the feeder base between the first and second apertures supports the stack of papers between the first and second apertures.

13. A paper shredder comprising:

a housing;

cutters positioned in the housing; and a feeder base coupled to the housing and adapted to support a stack of papers, the feeder base including a feeder slot through which paper passes for shredding in the cutters, the feeder base further including a first aperture on one side of the feeder slot; and a second aperture on a same side of the feeder slot as the first aperture;

wherein the first and second apertures provide pathways between a top surface of the feeder base and a waste area below the feeder base;

wherein the first and second apertures are spaced apart from one another by a portion of the feeder base between the first and second apertures; and wherein each of the first and second apertures has an edge including a compound angle with a first section oriented at a first angle relative to the feeder slot, and a second section oriented at a second angle relative to the feeder slot, the first angle being different from the second angle.

14. The paper shredder of claim 13, wherein the edge of the first aperture extends an entire width of the first aperture as measured in a direction parallel to the feeder slot, and the edge of the second aperture extends an entire width of the second aperture as measured in a direction parallel to the feeder slot.

15. The paper shredder of claim 13, wherein the edges of the first and second apertures that include the compound angle are configured so that a corner of papers in the stack fastened together by a staple, folds into the respective first or second aperture along a fold line that is oblique to the feeder slot, while the folded papers in the stack remain supported by the portion of the feeder base between the first and second apertures.

16. The paper shredder of claim 13, wherein the edge of each of the first and second apertures is an edge closest to the feeder slot.

17. The paper shredder of claim 13, further comprising a pressure plate mounted adjacent a bottom surface of a feeder door for applying pressure to the stack of papers.

18. A paper shredder comprising:

a housing;

cutters positioned in the housing; and a feeder base coupled to the housing and adapted to support a stack of papers, the feeder base including a feeder slot through which paper passes for shredding in the cutters, the feeder base further including an aperture formed in the feeder base at a location spaced from the feeder slot, the aperture providing a pathway between a top surface of the feeder base and a waste area below the feeder base and having an edge closest to the feeder slot with an angle that varies relative to the feeder slot.

19. The paper shredder of claim 18, wherein the edge extends an entire width of the aperture as measured in a direction parallel to the feeder slot.

20. The paper shredder of claim 18, wherein the edge defines a point having a tangent that is oblique to the feeder slot.

21. A paper shredder comprising:

a housing;

cutters positioned in the housing; and a feeder base coupled to the housing and adapted to support a stack of papers, the feeder base including a feeder slot through which paper passes for shredding in the cutters, the feeder base further including an aperture formed in the feeder base at a location spaced from the feeder slot, the aperture providing a pathway between a top surface of the feeder base and a waste area below the feeder base and an edge having multiple surfaces angled differently relative to one another that enhance an ability of the edge to peel away sheets of paper from the stack.

22. The paper shredder of claim 21, wherein the edge extends an entire width of the aperture as measured in a direction parallel to the feeder slot.

23. The paper shredder of claim 21, further comprising a feeder door that substantially covers the entire feeder base and is pivoted about an axis at one end of the feeder door;

a pressure plate mounted adjacent a bottom surface of the feeder door for applying pressure to the stack of papers; and a deflection member tilted relative to a horizontal plane to direct clips into a port providing passage into the waste area.

24. The paper shredder of claim 23, wherein the aperture is a first aperture and the feeder base further including a second aperture formed in the feeder base at a location spaced from the feeder slot and providing a pathway between a top surface of the feeder base and a waste area below the feeder base, the second aperture having an edge with multiple surfaces that enhance an ability of the edge of the second aperture to peel away sheets of paper from the stack.

25. The paper shredder of claim 1, wherein the aperture is a first aperture that facilitates the stack of paper supported on the feeder base folding over at a corner corresponding to the first aperture to assist sheets in the stack tearing away from a staple in the stack of papers that is adjacent the first aperture, and the feeder base further including a second aperture formed in the feeder base at a location spaced from the feeder slot and providing a pathway between a top surface of the feeder base and a waste area below the feeder base, the second aperture having an edge closest to the feeder slot including a compound angle with a first section oriented at a first angle relative to the feeder slot, and a second section oriented at a second angle relative to the feeder slot, the first angle being different from the second angle, and wherein the second aperture facilitates the stack of paper supported on the feeder base folding over at a corner corresponding to the second aperture to assist sheets in the stack tearing away from a staple in the stack of papers that is adjacent the second aperture.

* * * * *